United States Patent [19]

Sevcik et al.

[11] Patent Number: 4,625,771

[45] Date of Patent: Dec. 2, 1986

[54] APPARATUS FOR INSERTING TWO WEFT THREADS INTO TWO WARP SHEDS IN A LOOM WITH CENTRAL JET INSERTION

[75] Inventors: Ladislav Sevcik; Vladimir Svaty, both of Liberec, Czechoslovakia

[73] Assignee: Elitex, koncern textilniho strojirenstvi, Liberec, Czechoslovakia

[21] Appl. No.: 757,744

[22] Filed: Jul. 22, 1985

Related U.S. Application Data

[63] Continuation-in-part of Ser. No. 609,586, May 19, 1984, abandoned.

[51] Int. Cl.[4] ..... D03D 47/30

[52] U.S. Cl. ..... 139/435

[58] Field of Search ..... 139/435; 226/97

[56] References Cited

U.S. PATENT DOCUMENTS 3,693,668 9/1972 Svaty ..... 139/435

4,494,577 1/1985 Svat et al. ..... 139/435

*Primary Examiner*—Henry S. Jaudon

[57] ABSTRACT

An apparatus for inserting two weft threads into two warp sheds in a loom with central jet insertion. Intermediate inlet ducts and pairs of opposite outlet ducts and pairs of opposite outlet ducts and pairs of nozzles, respectively, communicate with said respective inlet ducts. Air points are provided to change the directions of advance of weft threads and input air streams, said air points having tipping nozzles which can be alternately opened and whose discharge directions of tipping air jets are mutually crosswise directed into said pairs of opposite outlet ducts.

5 Claims, 7 Drawing Figures

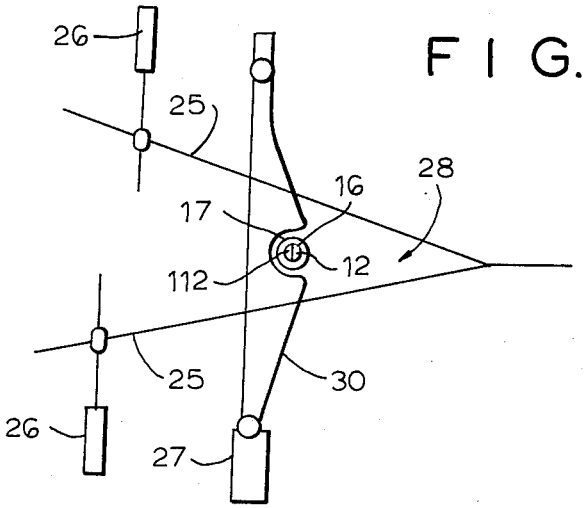
FIG. 4
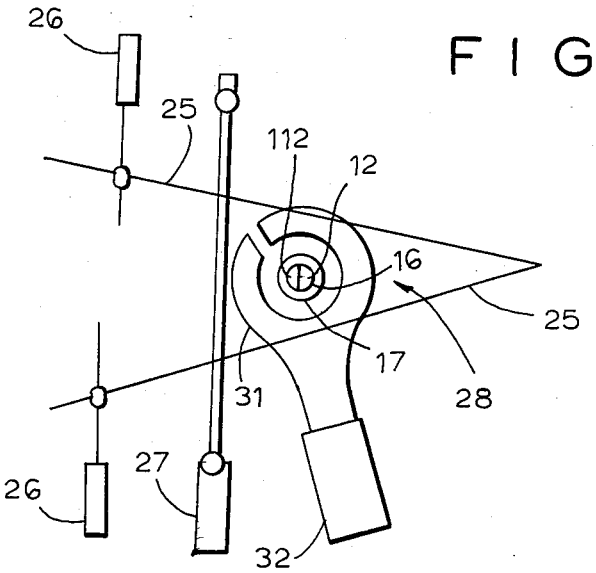
FIG. 5
FIG. 7
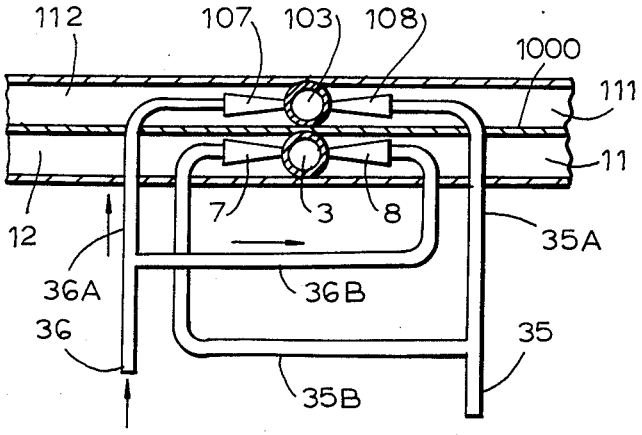

APPARATUS FOR INSERTING TWO WEFT THREADS INTO TWO WARP SHEDS IN A LOOM WITH CENTRAL JET INSERTION

CROSS-REFERENCE TO RELATED APPLICATION

This is a continuation-in-part application of our copending patent application Ser. No. 609,586 filed, on May 19, 1984, now abandoned.

BACKGROUND OF THE INVENTION

This invention relates to an apparatus for inserting two weft threads into two warp sheds in a loom with central jet insertion, wherein a programmed weft change is being carried out.

It is known to insert two weft threads into two different warp sheds, the latter being disposed in a side-by-side relation and the inserting device, i.e. a weft metering device and picking nozzles, located intermediate the warp sheds and forming a socalled central jet inserting device. To obtain a weft change (See, for example, British patent application No. 2,079,332), the devices displace the nozzles either mechanically by rotating them through 180° in order to insert the weft threads into the warp sheds in accordance with a program, in which case the device for high speed looms is expensive to manufacture and noisy, or there is used, for each of the two weft threads to be inserted, nozzles having their outlets directed into the two warp sheds; each one of the nozzles in such arrangement has its outlets directed into the two warp sheds; each nozzle has at least two pressure air feeds which can be alternately opened according to a program; such arrangement is disclosed in the British patent application No. 2,079,332. These pressure air feeds do not permit active action on the weft thread when it is changed from one warp shed into the opposite shed; since the weft threads act due to the kinetic energy of the stream only in the picking direction, changing of the direction of movement of the weft thread is caused only by negative pressure air streams; however, streams can be utilized which are produced by an ejector effect; these stream exert very low forces on the weft thread. For that reason, these devices are unreliable, particularly for higher loom speeds and heavier weft threads.

SUMMARY OF THE INVENTION

The above mentioned shortcomings are eliminated by the apparatus of the present invention, the gist of which resides in the facts that intermediate an inlet duct an two outlet ducts of the nozzle proper, communicating with said inlet duct, air points are provided to change the direction of advance of both the weft thread and the input air stream, said points having tipping nozzles which can be alternatively opened; the discharge directions of tipping of the air jets are mutually crosswise directed into the opposite outlets ducts.

By means of said air points for changing the direction of advance of a weft thread said points having tipping nozzles whose discharge directions of the tipping jets are mutually crosswise directed into the opposite outlet ducts, an effect is obtained such that said tipping jets deflect, by tipping, both the weft thread and the input air stream, the latter entering the air points under an active dynamic force. This active dynamic force acquires high values, since it is directly dependent on the kinetic energy of the tipping jet and allows a broad range of weft thread counts to be worked at high speeds of the loom, since the reliability of changing the insertion of weft threads into respective warp shed is secured.

BRIEF DESCRIPTION OF THE DRAWING

Other advantages and features of the present invention will be made apparent in the ensuing description and the accompanying drawings in which:

FIG. 4 is a view in end elevation of a discharge of opposite outlet ducts and a secondary nozzle into a groove in a contour reed;

FIG. 5 is a view in end elevation of a discharge into the teeth of a comb;

FIG. 7 is a general view of the device in FIG. 6 as drawn in section through a plane 7—7 in FIG. 6.

DETAILED DESCRIPTION

Figure 1:
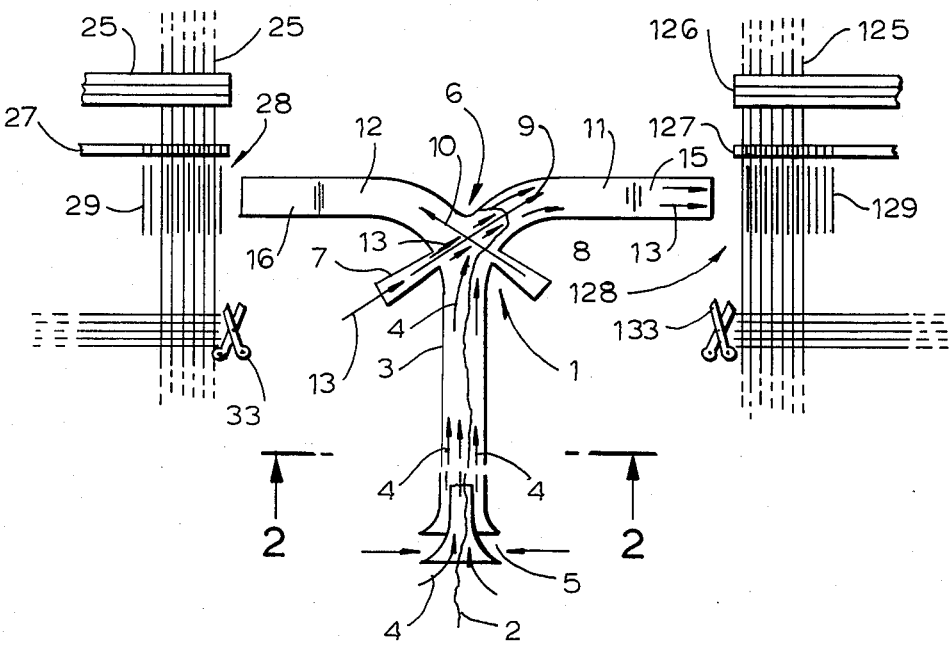
FIG. 1 is a schematic view of an apparatus for inserting two weft threads into two warp sheds, said apparatus having nozzles associated therewith and being provided with air points, as drawn in section along a plane 1—1 in FIG. 2.

Warp threads 25 controlled by heald shafts 36 form, together with a reed 27, a warp shed 28 which is located in opposing aligned relation to a warp shed 128 formed by warp thread 125 and a reed 127. In the warp sheds 28, 128 respectively there are further introduced broken channels 29, 129 respectively for the flight of weft thread 2, 102, respectively, through said warp sheds 28, 128, respectively. The broken channels 29, 129 are constituted by systems of teeth embodied, for example, as contoured dents 30 of the reed 27 or as teeth 31 of comb 32 and the like.

In the beat-up position of an inserted weft thread a severing device for the inserted weft threads has been diagrammatically shown, for example, cutters 33, 133, respectively. Associated with each weft thread 2, 102, respectively, is a nozzle 1, 101, respectively, having outlets directed into the two warp sheds 28, 128, respectively. Each nozzle 1, 101, respectively, comprises an inlet duct 3, 103, respectively, provided, at one end, with an inlet air nozzle 5 and, at the other end, communicating via air points 6, 106, respectively, with two opposite outlets ducts 11 and 12, 111, and 112, respectively.

The air nozzle 5 represents an auxiliary nozzle which operates with low pressure air (approximately 100 mm water column). Depending on the character of the weft, it is continuously supplied with pressurized air in case of heavy wefts or light wefts or in pressurized air is supplied. the pressurized air in case of a fire can be supplied by conventional means; for example, by means of a non-illustrated fan which is operatively mounted in a non-illustrated duct it can be supplied to the inlet nozzle 5.

The air points 6, 106, respectively, are constituted by pairs of tipping nozzles 7 and 8, 107, and 108, respectively, whose discharge directions 9, 10, respectively, corresponding to there of the tipping air jets 13, 14, respectively, are mutually crosswise directed into the two opposite outlet ducts 11 and 12, 111, and 112, respectively. On each outlet side the two neighboring opposite ducts 11, and 11, 12, and 112, respectively, of the two nozzles 1 and 101 discharge into common outlet ducts 15 and 16, respectively, the latter being surrounded by secondary nozzles 17, 18, respectively, having their own air supplies. The tipping nozzles 7 and 8, 107, and 108, respectively, can be alternately supplied (opened) by controlled air closure 37, with always two tipping nozzles 7 and 108, 8, and 107, respectively, of the nozzles 1 and 101, respectively, communicating with outlets 35, 36, respectively.

Figure 6:
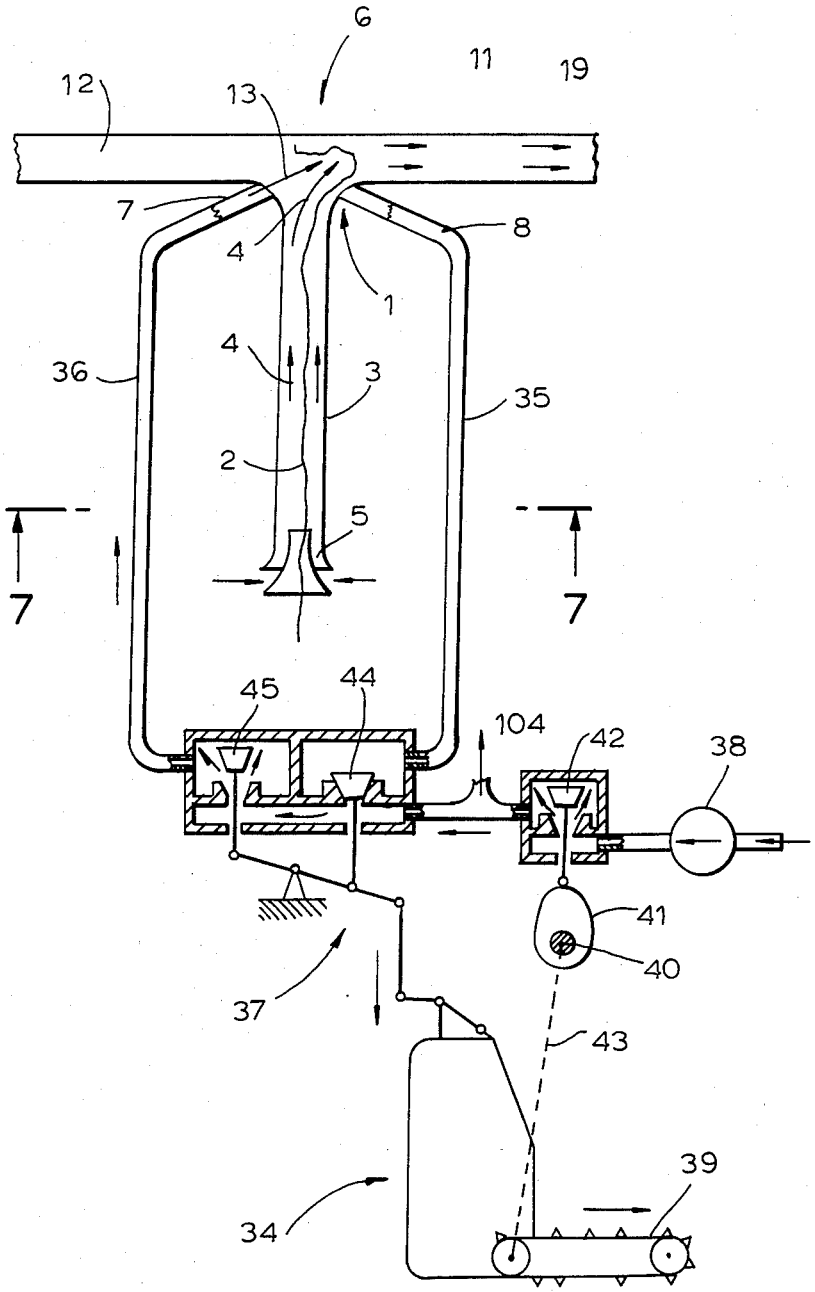
FIG. 6 is a detached view of an apparatus for inserting to weft threads into two warp sheds, the apparatus being provided with nozzles and air points, the latter being controlled by a programming device.

FIG. 6 illustrates the distribution means for pressurized air. For sake of clarity only two nozzles 7, 8, are illustrated.

FIG. 7 illustrates in detail the distribution of the pressurized air to the nozzles 7, 8, 107, and 108. As can be seen, the arrangement of FIG. 7 permits simultaneous insertion of the wefts and the weft 102 into opposite sheds; e.g. The weft 2 into shed 28, the weft 102 into the shed 128; thereafter the weft 2 into the shed 128 and the weft 102 into the shed 28.

Ducts 35*a*, 35*b*, and ducts 36*a*, 36*b* connect, respectively, the tipping nozzles 7, 8, 107, 108 to the compressor 38. Because weft 2 is always inserted into the opposite shed with respect to weft 102, the tipping nozzles 7 and 108 are connected by ducts 35, 35*a*, 35*b* to the compressor 38 via the values 45, 42. Depending on which one of the valves 44, 45 is open the weft 2 or 102 is inserted either by the tipping nozzles 4, 108 or by the tipping nozzles 8, 107.

The pressurized air is supplied from the tipping nozzles 7, 8, 107, 108 in such a manner that only two of these nozzles are simultaneously in operation (i.e. 7, 108 or 8, 107). Therefore, when the tipping nozzle 7 is in operation, the jet 13 moves in a direction 9 (see FIG. 1). The tipping nozzle 108 is simultaneously in operation with the tipping nozzle 7 (see FIG. 2). The jet 14 moves from the tipping nozzle 108 in the opposite direction (see FIG. 1) with respect to the jet emanating from the tipping nozzle 7. If thereafter the tipping nozzle 8 is pressed in operation, the jet streaming from it moves in the direction 10 (see FIG. 1). The tipping nozzle 107 is simultaneously placed into operation with the tipping nozzle 8. The jets streaming from the tipping nozzle 107 move in the opposite direction 9 (see FIG. 1).

Figure 2:
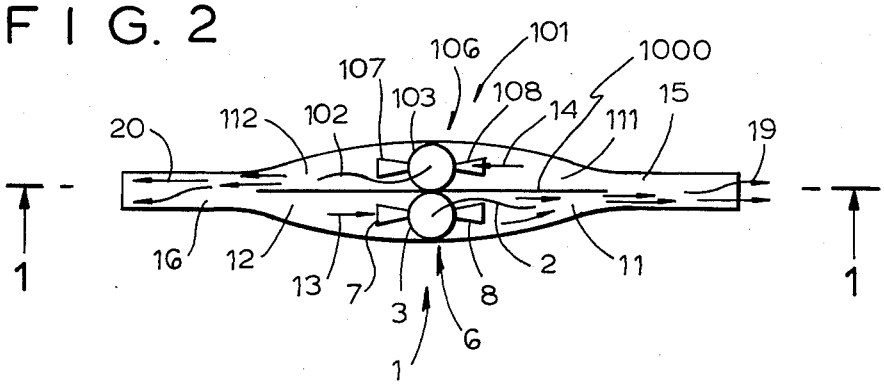
FIG. 2 is a view of the device drawn diagrammatically in section through a plane 2—2 in FIG. 1.

The output air jet 19 in accordance with FIG. 2 constitutes a composite either of the tipping air jet 13 streaming from the tipping nozzle 7 in the direction 9 and of the input air stream 4 supplied through the air inlet duct in the course of the weft insertion of the weft 2 into the shed 128 or of the tipping air jet 14 streaming from the tipping nozzle 108 and of the input air stream (not shown in the drawing) supplied through the air duct 103 in the course of the insertion of the weft 102 into the shed 28 or the tipping air jet 13 streaming from the nozzle 8 (according to FIG. 1 in the direction 10) and of the input air stream 4 (according to FIG. 1) supply through the duct 3 in the course of inserting the weft 2 into the shed 28.

The outlet ducts 11, 12 are separated from the outlet ducts 111, 112 by means of a barrier plate 1,000 (see FIG. 2). The ends of this barrier plate are indicated in FIG. 1 by thick lines. The outlet ducts 11, 111 of nozzles 1 and 101 are discharged into the common orifice 15. The outlet ducts 12, 112 of nozzles 1, 101 are discharged into the common orifice 16.

Thus, tipping nozzles 7, 8, 107, 108 are supplied with pressurized air for simultaneous insertion of two wefts 2, 102. The weft 2 is inserted into the shed 128 and weft 102 is inserted into the shed 28.

The pressurized air is supplied to the inlet nozzle 5 either by means of a fan, when heavy wefts are woven, or such pressurized air supply is disconnected when light wefts are woven in which case air can be fed into the ejection suction.

The tipping air jet 14 acting on the nozzles 107, 108 always inserts the weft 102 into the opposite shed as the tipping air jet 13 does.

Figure 3:
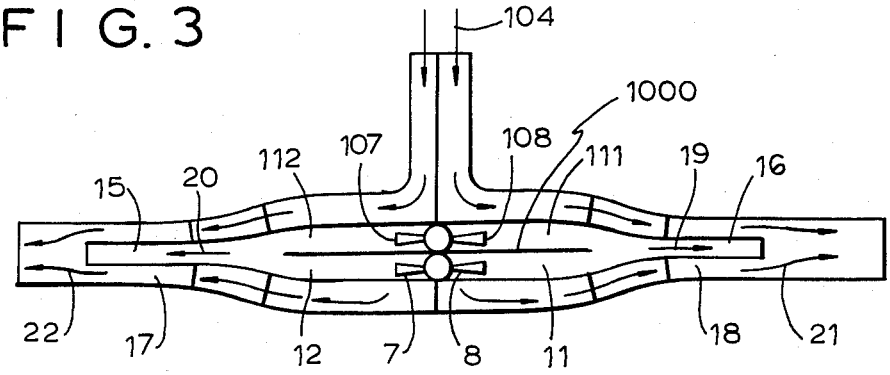
FIG. 3 is a view of an example of the device shown in FIGS. 1 and 2 but complemented by a secondary nozzle.

The nozzles 17 and 18 are primarily used to reinforce the air jets in the guiding channels 29, 129. The nozzles 17 and 18 are mounted on the arrangement as illustrated in FIG. 3. The effect of these additional auxiliary nozzles can be seen in FIG. 4. Pressurized air is supplied to these nozzles from the compressor 38 via duct 104 arranged behind the valve 42.

The controlled air closure 37, such as valves, slide valves and the like, are connected to a compressor 38 and a programming device 34. A program 39 of the programming device 34 can be recorded, for example, on magnetic tape and read in an electric manner, in which case the controller air closures are actuated by electromagnets, or the program 39 is stored in a mechanical manner, for example, on a belt, or a chain, in which case the transmission onto the controller air closure linkage 37 is carried out in a mechanical way or by another different combination.

In FIG. 6 has been shown, as an example, a mechanical manner of storage of the program 39 on a belt, the programming device 34 forming a part of a dobby which is also employed for a program control of the heald shafts 26, 126, respectively, by a transmission (not shown here). A main shaft 40 of the loom drives via a mechanism (not shown here) the reeds 27, 127, respectively, and also the air supply from the compressor 38 to the programming device is exactly synchronized, for example, by a cam 41 and an auxiliary valve 42. From the main shaft 40 there is further derived a drive 43 for the programming device 34, a dobby in the present case, which alternately, in accordance with a program, actuates the controlled air closures 37, valves 44, 45 in the present case.

The weft threads 2, 102, respectively, are prepared for insertion in a metering device (not shown here), and fed through the inlet duct 3, together with an input air stream 4, to the air points 6, 106.

In the air points 6, 106, respectively, a pair of the tipping nozzles 7 and 8, 107 and 108, respectively, are alternatively opened, whose discharge directions 9, 10, of the tipping air jets 13, 14 are mutually crosswise directed into the respective opposed outlet ducts 11 and 12, 111, and 112, respectively. The tipping jet 13 inserts the weft threads 2, 102, respectively, by an active dynamic force into the corresponding opposite duct 11, 12 either into shed 18 or 128 depending on which tipping nozzle 107 or 108 is in operation. When a weft thread is to be inserted into the warp shed 28, a tipping jet (not shown here), is discharged from the tipping nozzle 8 into the opposite duct 12.

The weft 2 after being inserted into the shed 128, as illustrated in FIG. 1, is beaten up by the reed 127 to the fabric. The weft 2 is then severed by the cutter 33 between the selvedge of the fabric and the orifice 15. By virtue of this arrangement it is possible to insert repeatedly according to the program the weft 2 into the shed 128 or to displace the weft 2 by means of the nozzle 8 from the duct 11 (severing by cutter 133) into duct 12 and then insert it into the duct 12.

After completing their flights through the guide channels 29, 129, respectively, the weft threads 2, 102, respectively, are beaten up by the corresponding reed and in their beat-up positions are severed by the cutters 33, 133, respectively. In order to increase the action of output air jets 19, 20, respectively, in the channels 29, 129, respectively, secondary air jets 21, 22, respectively, are fed in through the secondary nozzles 17, 18, respectively. The programming device 34 with its program 39 opens alternately, via a lever system, in accordance with the program the valves 44 and 45 and the outlets 35 and 36 supply the air into the tippng nozzles 7 and 8, 107, and 108 of the air points 6, 106 of the nozzles 7 and 8, 107, and 108 of the air points 6, 106 of the nozzles 1, 101, respectively, whereby the weft change into the warp sheds is controlled.

Although the invention is described and illustrated with reference to a plurality of embodiments thereof, it is to be expressly understood that is in no way limited to the disclosure of such preferred embodiments but is capable of numerous modifications within the scope of the appended claims.

We claim:

1. An apparatus for inserting two weft threads into warp sheds in a loom with central jet insertion, comprising a weft change motion device, nozzles associated with individual weft threads, the outlets of said nozzles being directed into two opposite warp sheds, which can supply air from alternate pressurized air means in accordance with a program, intermediate inlet ducts connected to the respective nozzles, and pairs of opposite outlet ducts in communication with the outlets of the respective nozzles, means for changing the directions of advance of the respective wefts, having tipping nozzles which can be alternately changed in their position in accordance with the program, the discharged directions of the respective tipping air jets being mutually crosswise directed into said respective pairs of opposite outlet ducts.

2. Apparatus as claimed in claim 1, wherein the inlet duct of each of the nozzles is provided with an inlet air nozzle.

3. An apparatus as claimed in claim 1, wherein each outlet duct has an outlet side, the pairs of neighboring opposite outlets of the two nozzles discharge into common outlet ducts.

4. An apparatus as claimed in claim 1, wherein there are output air jets connected to said pairs of opposite outlet ducts of the respective nozzles, said output air jets being surrounded by secondary air jets coming from respective secondary nozzles surrounding said opposite outlet.

5. An apparatus as claimed in claim 1, comprising a programming device in the form of a dobby actuating controlled air closures with outlets leading into the tipping nozzles of said air points of the nozzles.

* * * * *